US009109291B2

(12) United States Patent
Lamberton et al.

(10) Patent No.: US 9,109,291 B2
(45) Date of Patent: Aug. 18, 2015

(54) COLD SPRAY COATING PROCESS

(71) Applicant: GENERAL ELECTRIC COMPANY, Schenectady, NY (US)

(72) Inventors: Gary Austin Lamberton, Glenville, NY (US); Kathleen Blanche Morey, Scotia, NY (US); Andrew Batton Witney, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 92 days.

(21) Appl. No.: 13/901,686

(22) Filed: May 24, 2013

(65) Prior Publication Data

US 2014/0349007 A1 Nov. 27, 2014

(51) Int. Cl.
*C23C 24/04* (2006.01)
*C23C 24/00* (2006.01)

(52) U.S. Cl.
CPC ..... *C23C 24/00* (2013.01); *C23C 24/04* (2013.01)

(58) Field of Classification Search
CPC ..... C23C 24/00; C23C 24/04
USPC ..... 427/230–239
See application file for complete search history.

(56) References Cited

U.S. PATENT DOCUMENTS

| | | | | |
|---|---|---|---|---|
| 2,381,797 | A | 8/1945 | Adels | |
| 4,435,448 | A | 3/1984 | Nolt, Jr. | |
| 6,117,565 | A | 9/2000 | Wengler et al. | |
| 6,416,877 | B1 | 7/2002 | Perrin et al. | |
| 2006/0013952 | A1 * | 1/2006 | Nakashima et al. | 427/230 |
| 2009/0232431 | A1 * | 9/2009 | Roeingh et al. | 384/295 |
| 2010/0170937 | A1 | 7/2010 | Calla | |
| 2011/0193338 | A1 * | 8/2011 | Carter | 285/18 |
| 2012/0128284 | A1 * | 5/2012 | Mordente | 384/276 |

FOREIGN PATENT DOCUMENTS

| | | | |
|---|---|---|---|
| DE | 102004043914 | A1 | 3/2006 |
| DE | 102006060021 | A1 | 6/2008 |

OTHER PUBLICATIONS

European Search Report and Opinion issued in connection with corresponding EP Application No. 14168673.3-1362 on Oct. 23, 2014.

* cited by examiner

*Primary Examiner* — Alexander Weddle
(74) *Attorney, Agent, or Firm* — McNees Wallace & Nurick LLC

(57) ABSTRACT

A cold spray coating process is disclosed. The cold spray coating process includes positioning a cold spray nozzle relative to a bearing assembly, rotating the bearing assembly, and directing a powdered babbitt material through the cold spray nozzle, to a surface of the rotating bearing assembly. The powdered babbitt material adheres to the surface of the rotating bearing assembly, forming a coating on the surface. Another cold spray coating process includes positioning the cold spray nozzle relative to a bearing assembly, rotating the cold spray nozzle, and directing a powdered babbitt material through the cold spray nozzle, to a surface of the bearing assembly. The powdered babbitt material adheres to the surface, the rotating of the cold spray nozzle forming a coating on the surface. Another cold spray coating process includes monitoring properties of the coating on the surface of the bearing assembly with a coating monitor.

16 Claims, 2 Drawing Sheets

COLD SPRAY COATING PROCESS

FIELD OF THE INVENTION

The present invention is directed to coating processes. More particularly, the present invention is directed to cold spray coating processes.

BACKGROUND OF THE INVENTION

Various materials used in industrial applications are subject to a diverse set of hostile conditions. For example, certain turbine components are subjected to thermally, mechanically and chemically stressful environments which can be harmful to the components. Often, a material's surface is provided with a protective coating specific to the operating conditions and intended use. As one example, turbine bearings are often coated with a protective babbitt material. However, coating of the material's surface can be difficult to control, unpredictable, time consuming, space consuming and costly.

Babbitt material is typically applied to component surfaces using centrifugal force while the component is spinning To apply babbitt coating this way, the babbitt material must be in liquid form. Additionally, the component to which the coating is being applied must be pre-heated. Such a technique suffers from various drawbacks. Such a technique requires a large pot of melted babbitt material, is limited in application based upon component shape, may result in wasted babbitt material during application, may result in poor surface properties, may result in excess babbitt material being machined away, can suffer from phase separation during application, requires spinning of the component, or combinations thereof.

After coating, as a component is subjected to wear during operation, damage to the babbitt material occurs in various areas. The damaged babbitt material, if detected early, is repaired in order to prevent damage to the component itself One example method of repair involves stripping of the babbitt material, preparing the surface of the component for re-application of liquid babbitt, subsequent machining, or combinations thereof. Such methods are time consuming, can be costly, can result in damage to the component, may lead to further wasted babbitt material during application and machining, or combinations thereof.

A coating process and coated article that do not suffer from the above drawbacks would be desirable in the art.

BRIEF DESCRIPTION OF THE INVENTION

In an embodiment, a cold spray coating process for propelling a powdered babbitt material using a cold spray nozzle includes positioning the cold spray nozzle relative to a bearing assembly, rotating the bearing assembly, and directing the powdered babbitt material through the cold spray nozzle, to a surface of the rotating bearing assembly. The powdered babbitt material adheres to the surface of the rotating bearing assembly, forming a coating on the surface of the rotating bearing assembly.

In another embodiment, a cold spray coating process for propelling a powdered babbitt material using a cold spray nozzle includes positioning the cold spray nozzle relative to a bearing assembly, rotating the cold spray nozzle, and directing the powdered babbitt material through the cold spray nozzle, to a surface of the bearing assembly. The powdered babbitt material adheres to the surface of the bearing assembly, the rotating of the cold spray nozzle forming a coating on the surface of the bearing assembly.

In another embodiment, a cold spray coating process for propelling a powdered babbitt material using a cold spray nozzle includes positioning the cold spray nozzle relative to a bearing assembly, rotating the cold spray nozzle and the bearing assembly relative to each other, directing the powdered babbitt material through the cold spray nozzle, to a surface of the bearing assembly, adhering the powdered babbitt material to the surface of the bearing assembly, the adhering of the babbitt material forming a coating on the surface of the bearing assembly, monitoring one or more properties of the coating on the surface of the bearing assembly with a coating monitor, transmitting a first signal from the coating monitor to a coating analyzer, analyzing the first signal from the coating monitor with the coating analyzer, sending a second signal from the coating analyzer to a coating control device, and configuring the cold spray nozzle with the coating control device in response to the second signal.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a coating process. Embodiments of the present disclosure, in comparison to processes and articles not using one or more of the features disclosed herein, decrease post-coating machining, increase uniformity of coating, increase efficiency of coating, or a combination thereof.

Figure 1:
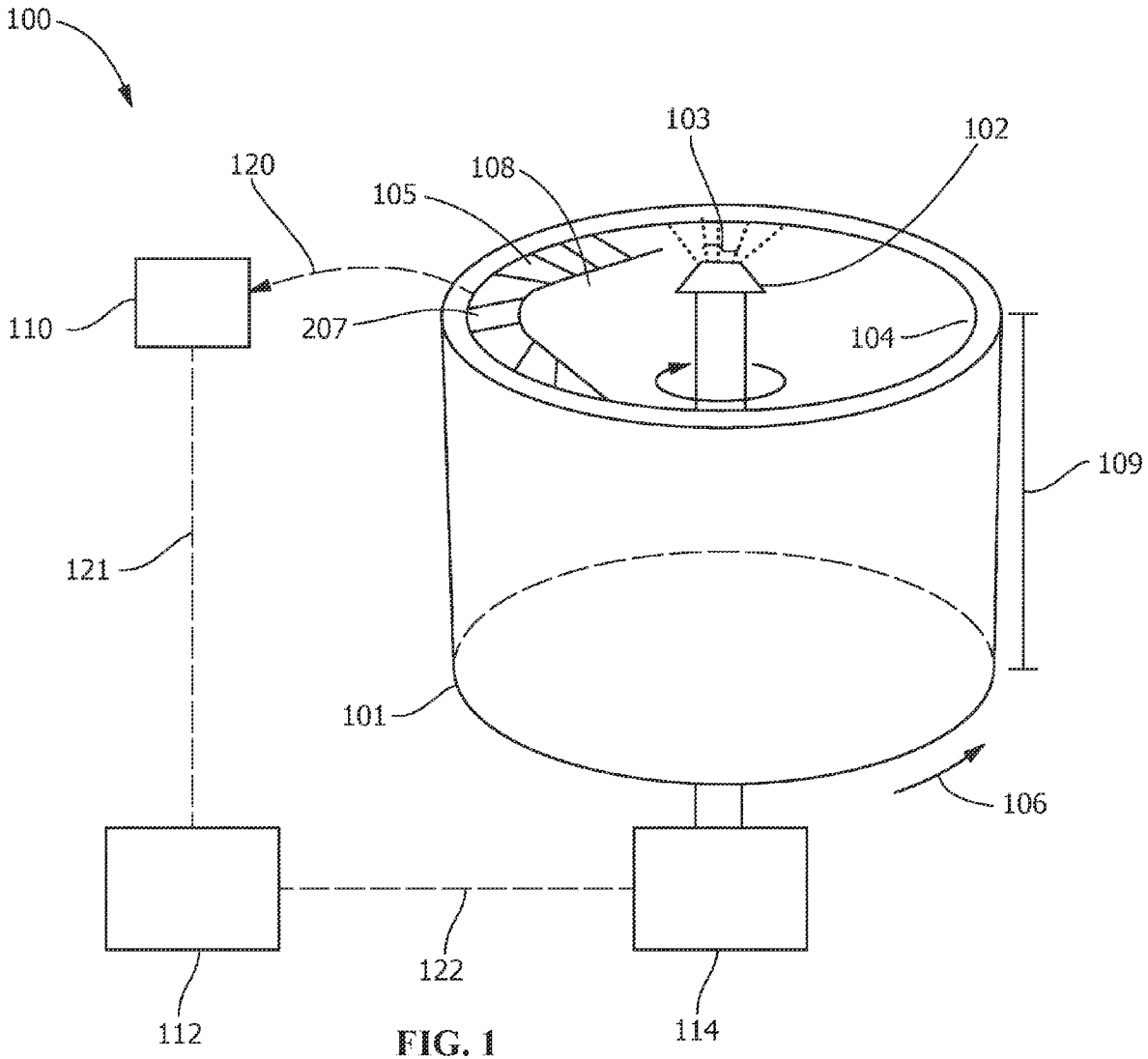
FIG. 1 is a perspective view of a cold spray nozzle positioned within a bearing according to an embodiment of the invention.

Referring to FIG. 1, in one embodiment, a cold spray apparatus 100 includes a cold spray nozzle 102 positioned relative to a bearing assembly 101. The bearing assembly 101 includes any type of bearing such as, but not limited to, a gas turbine bearing, a full bearing, a half bearing, a damaged bearing, or a combination thereof. A powdered babbitt material 103 is directed through the cold spray nozzle 102 to a surface 104 of the bearing assembly 101. The surface 104 includes, but is not limited to, a coated surface, a damaged surface, an uncoated surface, a surface having an area with diminished coating, or a combination thereof. The cold spray nozzle 102 propels the powdered babbitt material 103 to the surface 104 of the bearing assembly 101. The powdered babbitt material 103 adheres to the surface 104 of the bearing assembly 101, forming a coating 105 on the surface 104. In one embodiment, the coating 105 is a re-coating of the surface 104 of the bearing assembly 101. In a further embodiment, the surface 104 of the bearing assembly 101 is not stripped prior to the re-coating.

In one embodiment, properties of the coating 105 are electronically monitored and controlled through adjustments to the cold spray nozzle 102. Properties of the coating 105 include, but are not limited to, thickness, distribution, or a combination thereof. Adjustment of the cold spray nozzle 102 includes, but is not limited to, speed of rotation, distribution of powdered babbitt material 103, amount of the powdered babbitt material 103 propelled, spray pattern of the powdered babbitt material 103, or a combination thereof.

In one embodiment, a coating monitor 110 acquires information 120 corresponding to at least one property of the coating 105 in real time. The coating monitor 110 acquires information 120 through any suitable method capable of measuring any suitable property of the coating 105 in real time. Suitable methods of measuring at least one property of the coating 105 include, but are not limited to, visual light measurements (such as white light/blue light), laser thickness measurements, temperature measurements, or a combination thereof. Suitable properties of the coating 105 for measurement include, but are not limited to, thickness, temperature, density, or a combination thereof.

The coating monitor 110 generates a first signal 121 based upon the properties of the coating 105 and sends the first signal 121 to a coating analyzer 112. The coating analyzer 112 receives the first signal 121, analyzes the properties of the coating 105, and generates a second signal 122. The coating analyzer 112 sends the second signal 122 to a coating control device 114. The second signal 122 includes information for adjusting the cold spray nozzle 102, to form a desired final coating, based upon the properties of the coating 105 acquired in real time by the coating monitor 110. In response to the second signal 122, the coating control device 114 configures the cold spray nozzle 102 by altering the coating parameters or settings of the cold spray nozzle 102 or maintaining the coating parameters or settings of the cold spray nozzle 102. Suitable coating parameters capable of being altered include, speed of the cold spray nozzle 102, gas flows, coating path, or a combination thereof. The coating monitor 110 continues acquiring information 120 on the properties of the coating 105 after the coating control device 114 adjusts the cold spray nozzle 102, forming a continuous loop.

In one embodiment, the coating control device 114 adjusts the cold spray nozzle 102 to form an even distribution of the coating 105. In one embodiment, the coating control device 114 adjusts the cold spray nozzle 102 to maintain a desirable thickness of the coating 105. The desirable thickness of the coating 105 is decreased as compared to a coating formed from centrifugal coating. Decreasing the thickness of the coating 105 eliminates over-coating and/or a need for machining to finalize the coating 105. In one embodiment, the coating control device 114 directs the cold spray nozzle 102 to a damaged area of the bearing assembly 101.

The cold spray apparatus 100 forms the coating 105 on the surface 104 by impacting the powdered babbitt material 103 in the absence of significant heat input to the powdered babbitt material 103. The cold spraying process 100 substantially retains the phases and microstructure of the powdered babbitt material 103. In one embodiment, the cold spraying (step 304) includes accelerating the powdered babbitt material 103 to at least a predetermined velocity or velocity range, for example, based upon the below equation for a converging-diverging nozzle:

$$\frac{A}{A^*} = \frac{1}{M}\left[\frac{2}{\gamma+1}\right]\left[1+\left(\frac{\gamma-1}{2}\right)M^2\right]^{\frac{\gamma+1}{2(\gamma-1)}} \quad \text{(Equation 1)}$$

In Equation 1, "A" is the area of an exit of the cold spray nozzle 102 and "A*" is the area of a throat of the cold spray nozzle 102. "γ" is the ratio $C_p/C_v$ of a process gas being used ($C_p$ being the specific heat capacity at constant pressure and $C_v$ being the specific heat capacity at constant volume). The gas flow parameters depend upon the ratio of A/A*. When the cold spray nozzle 102 operates in a choked condition, the exit gas velocity Mach number (M) is identifiable by Equation 1. Gas having a higher value for "γ" results in a higher Mach number. The powdered babbitt material 103 impacts the surface 104 of the bearing assembly 101 at the predetermined velocity or velocity range and the powdered babbitt material 103 bonds to the surface 104 of the bearing assembly 101 to form the coating 105.

The cold spray nozzle 102 is positioned a predetermined distance from the surface 104 of the bearing assembly 101, for example, between about 10 mm and about 150 mm, between about 10 mm and about 50 mm, between about 50 mm and about 100 mm, between about 10 mm and about 30 mm, between about 30 mm and about 70 mm, between about 70 mm and about 100 mm, or any suitable combination or sub-combination thereof. In one embodiment, the cold spray nozzle 102 is positioned in a center of the bearing assembly 101. The cold spray nozzle 102 positioned in the center of the bearing assembly 101 is rotated in place, providing an equal distance between the cold spray nozzle 102 and the surface 104 throughout a 360° rotation. In one embodiment, the cold spray nozzle 102 forms a concentric arrangement within the bearing assembly 101. The cold spray nozzle 102 in the concentric arrangement is moved in a circle within the bearing assembly 101 such that a distance between the cold spray nozzle 102 and the surface 104 is maintained throughout a 360° movement.

In one embodiment, a babbitt material is a metal matrix that forms a surface layer. The metal matrix is a composite having crystals dispersed in a metal. In one embodiment, the babbitt material is used as a protective coating and/or a lubricant for the surface 104 of the bearing assembly 101. The crystals are relatively hard as compared to the metal, and form a non-lubricating portion of the surface layer. The babbitt material includes, but is not limited to, tin, copper, lead, or a combination thereof. Suitable compositions of babbitt material include, but are not limited to, 90% tin and 10% copper; 89% tin, 7% antimony and 4% copper; 80% lead, 15% antimony and 5% tin; 76% copper and 24% lead; 75% lead and 10% tin; 67% copper, 28% tin and 5% lead; or combinations thereof. For babbitt material compositions including tin, friction from using the bearing assembly 101 generates heat which melts the tin in the babbitt material. The melted tin forms a lubricant for protecting the surface 104 of the bearing assembly 101.

In one embodiment, the bearing assembly 101 is rotated 106 while the cold spray nozzle 102 is held stationary. The rotation 106 of the bearing assembly 101 while spraying powdered babbitt material 103 forms a circular strip of the coating 105 over the surface 104. In one embodiment, the cold spray nozzle 102 is rotated 107 while the bearing assembly 101 is held stationary. The rotation 107 of the cold spray nozzle 102 while spraying powdered babbitt material 103 forms the circular strip of the coating 105 over the surface 104.

In one embodiment, the cold spray nozzle 102 propels the powdered babbitt material 103 in a pattern that covers a portion of a height 109 of the bearing assembly 101. A full rotation of the cold spray nozzle 102 or the bearing assembly 101 forms the circular strip of the coating 105 on the surface 104 of the bearing assembly 101. The cold spray nozzle 102 is adjusted relative to the height 109 of the bearing assembly 101 and powdered babbitt material 103 is propelled to an uncoated portion 108 of the bearing assembly 101. The cold spray nozzle 102 or the bearing assembly 101 is fully rotated forming another circular strip of the coating 105. The adjusting of the cold spray nozzle and the forming of the circular strip of the coating 105 is repeated until the surface 104 is adequately covered in the coating 105.

Figure 2:
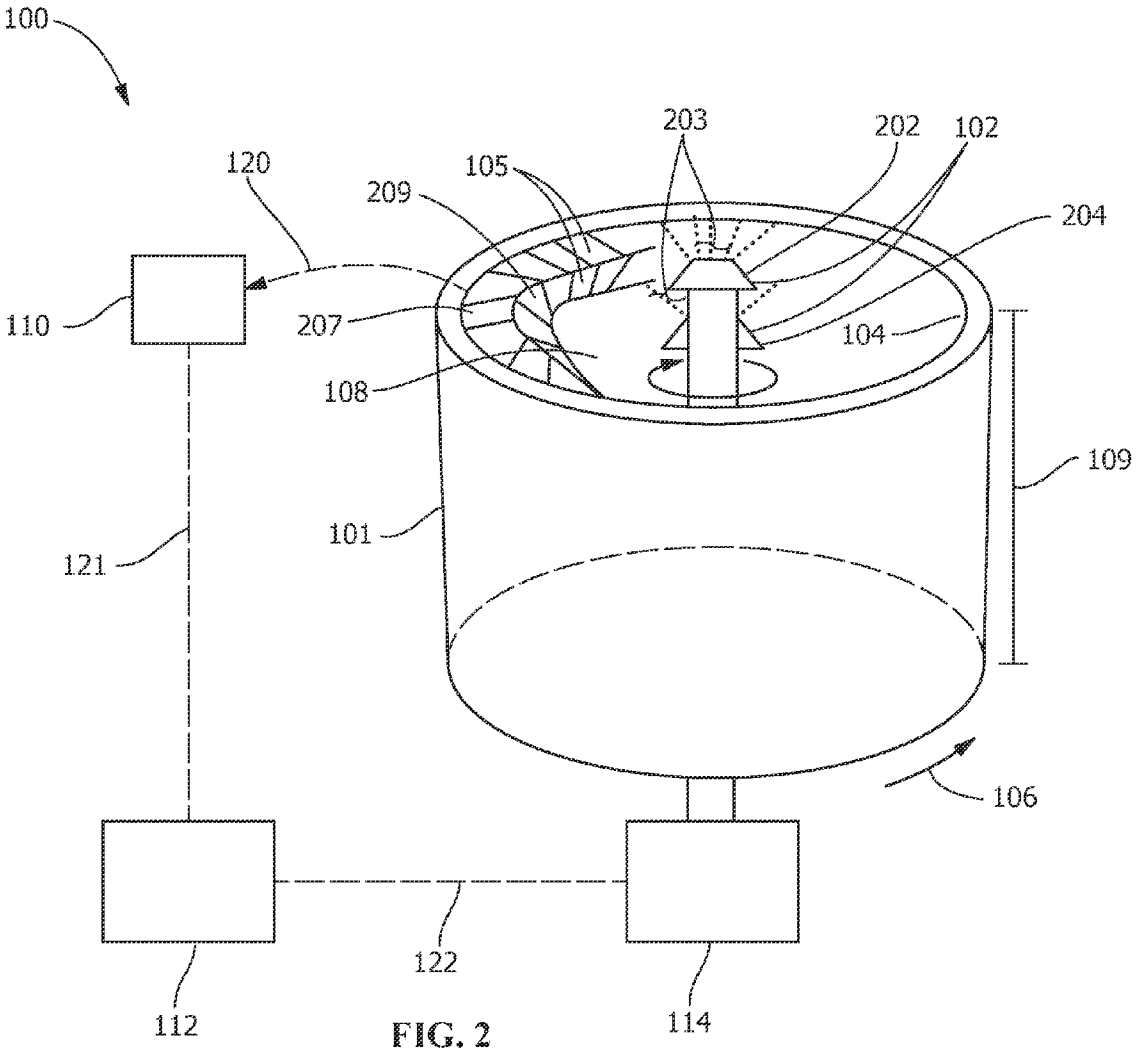
FIG. 2 is a perspective view of a plurality of cold spray nozzles positioned within a bearing according to an embodiment of the invention.

Referring to FIG. 2, in one embodiment, a plurality of cold spray nozzles 102 are positioned relative to a bearing assembly 101. Each of the cold spray nozzles 102 propels the powdered babbitt material 103 in a pattern that covers a portion of the height 109 of the bearing assembly 101. An increase in the number of the cold spray nozzles 102 increases the portion of the height 109 covered in the coating 105 during a single full rotation.

An alternate cold spray apparatus 100 includes a first cold spray nozzle 202 and a second cold spray nozzle 204 positioned relative to the bearing assembly 101. The first cold spray nozzle 202 and the second cold spray nozzle 204 both propel the powdered babbitt material 103 to the surface 104 of the bearing assembly 101. The first cold spray nozzle 202 forms a first circular strip 207 of the coating 105 at a first position, and the second cold spray nozzle 204 forms a second circular strip 209 of the coating 105 at a second position. The first position and the second position are similar, substantially similar, or differ relative to the height 109 of the bearing assembly 101. In one embodiment, the first cold spray nozzle 202 and the second cold spray nozzle 204 face 180° apart, such that rotating the nozzles 180° forms the coating 105 over 360° of the surface 104 of the bearing assembly 101. In another embodiment, a separate feeder is provided for the first cold spray nozzle 202 and the second cold spray nozzle 204. The separate feeders permit the propulsion of different material combinations at one time, forming a composite or gradient in the coating 105. Additionally, the separate feeders permit changes to a chemistry of the coating 105 as a function of a thickness of the Babbitt material.

In one embodiment, speeds of rotation include, but are not limited to, between about 0.5 rotations per minute (RPM) and about 5 RPMs, between about 1 RPM and about 3 RPMs, between about 2 RPMs and about 4 RPMs, or any combination, sub-combination, range, or sub-range thereof. Suitable thicknesses of the coating 105 include, but are not limited to, between about 1 mil and about 2000 mils, between about 1 mil and about 500 mils, between about 10 mils and about 500 mils, between about 20 mils and about 400 mils, between about 30 mils and about 200 mils, between about 40 mils and about 100 mils, or any suitable combination or sub-combination thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cold spray coating process for propelling a powdered babbitt material using a cold spray nozzle, the cold spray coating process comprising:

positioning the cold spray nozzle relative to a bearing assembly;

rotating the bearing assembly;

directing the powdered babbitt material through the cold spray nozzle, to a surface of the rotating bearing assembly; and electronically controlling the cold spray nozzle;

wherein the powdered babbitt material adheres to the surface of the rotating bearing assembly, forming a coating on the surface of the rotating bearing assembly.

2. The cold spray coating process of claim 1, further comprising repairing a damaged bearing assembly.

3. The cold spray coating process of claim 1, further comprising re-coating the surface of the bearing assembly.

4. The cold spray coating process of claim 3, wherein the surface of the bearing assembly is not stripped prior to re-coating.

5. The cold spray coating process of claim 3, wherein the surface of the bearing assembly comprises an area having diminished coating.

6. The cold spray coating process of claim 1, further comprising evenly distributing the coating on the surface of the rotating bearing assembly.

7. The cold spray coating process of claim 1, wherein the coating is not machined prior to installation.

8. The cold spray coating process of claim 1, further comprising electronic monitoring of one or more properties of the coating.

9. The cold spray coating process of claim 1, further comprising real time monitoring of a thickness of the coating.

10. The cold spray coating process of claim 1, further comprising a plurality of the cold spray nozzles positioned relative to the bearing assembly.

11. The cold spray coating process of claim 1, wherein the powdered babbitt material includes copper, lead, or a combination thereof.

12. The cold spray coating process of claim 1, wherein tin application is not required prior to directing the powdered metal material through the cold spray nozzle.

13. The cold spray coating process of claim 1, wherein rotating the bearing assembly is provided at a speed of rotation between about 0.5 rotations per minute and 5 rotations per minute.

14. The cold spray coating process of claim 1, wherein the powdered babbitt material has a composition, by weight, of about 76% copper and about 24% lead.

15. A cold spray coating process for propelling a powdered babbitt material using a cold spray nozzle, the cold spray coating process comprising:

positioning the cold spray nozzle relative to a bearing assembly;

rotating the cold spray nozzle and the bearing assembly relative to each other;

directing the powdered babbitt material through the cold spray nozzle, to a surface of the bearing assembly;

adhering the powdered babbitt material to the surface of the bearing assembly, the adhering of the babbitt material forming a coating on the surface of the bearing assembly;

monitoring one or more properties of the coating on the surface of the bearing assembly with a coating monitor;

transmitting a first signal from the coating monitor to a coating analyzer;

analyzing the first signal from the coating monitor with the coating analyzer;

sending a second signal from the coating analyzer to a coating control device; and configuring the cold spray nozzle with the coating control device in response to the second signal.

16. The cold spray coating process of claim 15, wherein manipulation of the cold spray nozzle comprises speed of rotation, distribution of powdered babbitt material, amount of the powdered babbitt material propelled, and spray pattern of the powdered babbitt material.

* * * * *